US006244200B1

(12) United States Patent
Rabovitser et al.

(10) Patent No.: US 6,244,200 B1
(45) Date of Patent: Jun. 12, 2001

(54) LOW $NO_X$ PULVERIZED SOLID FUEL COMBUSTION PROCESS AND APPARATUS

(75) Inventors: Iosif K. Rabovitser, Skokie; Richard Knight, Brookfield; Mark J. Khinkis, Morton Grove; Hamid A. Abbasi, Naperville; Stan Wohadlo, Lansing, all of IL (US)

(73) Assignee: Institute of Gas Technology, Des Plaines, IL (US)

( * ) Notice: Subject to any disclaimer, the term of this patent is extended or adjusted under 35 U.S.C. 154(b) by 0 days.

(21) Appl. No.: 09/591,734

(22) Filed: Jun. 12, 2000

(51) Int. Cl.[7] ..... F23C 1/12; F23G 7/06; F23L 15/00

(52) U.S. Cl. ..... 110/347; 110/260; 110/261; 110/262; 110/211; 110/302; 110/304; 110/345; 110/346

(58) Field of Search ..... 110/260, 261, 110/262, 265, 211, 224, 229, 233, 302, 303, 304, 342, 345, 346, 347

(56) References Cited

U.S. PATENT DOCUMENTS

| | | | | |
|---|---|---|---|---|
| 3,788,796 | * | 1/1974 | Krippene et al. | 431/2 |
| 4,528,918 | * | 7/1985 | Sato et al. | 110/347 |
| 4,573,418 | * | 3/1986 | Marzendorfer et al. | 110/345 |
| 4,688,496 | | 8/1987 | Schreter | 110/264 |
| 4,702,180 | | 10/1987 | Kiga | 110/263 |
| 4,704,971 | | 11/1987 | Fleischer et al. | 110/264 |
| 4,744,315 | | 5/1988 | Suwa et al. | 110/347 |
| 4,761,132 | * | 8/1988 | Khinkis | 431/10 |
| 4,854,249 | * | 8/1989 | Khinkis et al. | 110/342 |
| 4,909,727 | * | 3/1990 | Khinkis | 431/10 |
| 4,993,332 | | 2/1991 | Boross et al. | 110/347 |
| 5,229,000 | | 7/1993 | Ben-Nasr et al. | 210/634 |
| 5,231,937 | | 8/1993 | Kobayashi et al. | 110/262 |
| 5,425,317 | * | 6/1995 | Schaub et al. | 110/346 |
| 5,687,658 | | 11/1997 | Streffing et al. | 110/347 |
| 5,697,306 | | 12/1997 | LaRue et al. | 110/261 |
| 5,724,897 | | 3/1998 | Breen et al. | 110/261 |
| 5,771,823 | | 6/1998 | Vierstra et al. | 110/341 |
| 5,799,594 | | 9/1998 | Dernjatin et al. | 110/265 |
| 5,829,369 | | 11/1998 | Sivy et al. | 110/347 |
| 5,832,847 | | 11/1998 | Leisse et al. | 110/347 |
| 5,857,421 | * | 1/1999 | Doron | 110/346 |
| 5,908,003 | | 6/1999 | Hura et al. | 110/345 |
| 6,101,958 | * | 9/2000 | Beckman et al. | 110/346 |

* cited by examiner

*Primary Examiner*—Denise L. Ferensic
*Assistant Examiner*—K. B. Rinehart
(74) *Attorney, Agent, or Firm*—Pauley Petersen Kinne & Fejer

(57) ABSTRACT

A method and apparatus for low-$NO_x$ combustion of a pulverized solid fuel in which combustion products from a partial oxidation combustor are mixed with a pulverized solid fuel, thereby preheating the pulverized solid fuel and resulting in devolatilization of at least a portion of the pulverized solid fuel. The preheated pulverized solid fuel and the devolatilization products are then burned in a burner firing directly into a combustion chamber.

31 Claims, 5 Drawing Sheets

LOW $NO_X$ PULVERIZED SOLID FUEL COMBUSTION PROCESS AND APPARATUS

BACKGROUND OF THE INVENTION

1. Field of the Invention

This invention relates to a method and apparatus for pulverized solid fuel combustion that results in $NO_x$ emissions reduction, and combustion performance improvement, such as improvements in flame stability, turn down capability, etc., in pulverized solid fuel combustion systems. More particularly, this invention is directed to a method and apparatus for pulverized coal (PC) combustion that results in $NO_x$ emissions reduction, and combustion performance improvement, such as improvements in flame stability, turn down capability, etc., in pulverized coal combustion systems. The invention is applicable to pulverized solid fuel combustion processes and systems, and in particular pulverized coal combustion processes and systems, for furnaces, boilers, and other combustion chambers.

2. Description of Prior Art

The utilization of coal and other solid fuels, such as wood waste and biomass, for power generation as well as other applications results in emissions of nitrogen oxides ($NO_x$) which are formed primarily as a result of oxidation of the nitrogen inherent in the fuel and oxidation of molecular nitrogen present in the combustion air. Nitrogen oxides released in the atmosphere contribute to acid rain, accelerate the photochemical reactions responsible for smog, and result in increased ground level ozone concentrations. $NO_x$ can also be formed when high temperatures (greater than about 2700° F.) are sustained in a flame region where nitrogen and oxygen are present. Under this condition, the molecular nitrogen dissociates and recombines with oxygen forming thermal $NO_x$.

It is known that lower $NO_x$ emissions can be obtained from pulverized coal flames by staging or delaying the mixing of some of the combustion air with the fuel so that the released nitrogen volatiles combine to form molecular nitrogen instead of $NO_x$. In the reducing atmosphere produced by staging, molecules of $NO_x$ that do form can also be more readily reduced back to molecular nitrogen. This process of staging may be completed externally to the burner by removing some of the combustion air from the burner and introducing it at another location in the furnace.

The art is replete with processes and devices for combustion of pulverized coal including the combustion of pulverized coal in a manner which reduces $NO_x$ emissions. U.S. Pat. No. 5,908,003 to Hura et al. teaches a process and apparatus for combustion of a solid carbonaceous material in which a mixture of the solid carbonaceous material and combustion air is injected into a combustion chamber and ignited, thereby forming a fuel-lean primary combustion zone, and a gaseous fuel is injected into the combustion chamber downstream of the primary combustion zone, thereby forming a fuel-lean secondary combustion zone. U.S. Pat. No. 5,724,897 to Breen et al. teaches a pulverized coal burner which includes fuel splitters for separation of a mixture of primary air and coal into a plurality of streams while the mixture is discharged through a diffuser having a plurality of partially open areas and a plurality of blocked areas. After passing through the diffuser, the plurality of streams are discharged into a furnace to be burned. U.S. Pat. No. 5,771,823 to Vieistra et al. teaches a method and apparatus for reducing $NO_x$ emissions from multiple-intertube pulverized coal burners in which an internal two-stage process controls the amount of secondary air flow into the burner. The first stage includes the secondary air damper and air flow station to regulate the amount of air which flows into the windbox of the burner. The baffle plate assembly limits the amount of air which flows to the core of the burner for combustion of the fuel by diverting a quantity of air to the periphery of the burner. The second stage includes an outlet formed in the hot primary air ducts, an air plenum which communicates therewith, and a plurality of interjectory air ports which correspond with the burner in number and position along the front wall of the boiler and which communicate with the air plenum. The interjectory air ports inject interjectory air into the combustion chamber of the boiler at a 90° angle to the direction of the burner tips of each burner, supplying the balance of combustion air needed for complete combustion of the fuel. U.S. Pat. No. 5,829,369 to Sivy et al. teaches a pulverized coal burner having a pulverized fuel transport nozzle surrounded by a transition zone which shields a central oxygen-lean fuel devolatilization zone from the swirling secondary combustion air. The transition zone acts as a buffer between the primary and the secondary combustion air streams to improve the control of the air-burner mixing and the flame stability by providing a limited recirculation region between primary and secondary combustion air streams. The limited recirculation regions transport evolved $NO_x$ back towards the oxygen-lean fuel devolatilization zone for reduction to molecular nitrogen. The burner may be configured to fire a combination of fossil fuels, for example, pulverized coal delivered through the primary zone with a small amount of natural gas being injected through the transition zone, wherein the natural gas constitutes between about 5–15% of the burner thermal input. U.S. Pat. No. 5,231,937 to Kobayashi et al. teaches a burner for pulverized coal comprising a coal duct for pulverized coal and primary combustion air and a secondary combustion air duct whereby the coal and primary combustion air and secondary combustion air mix outside the outlet nozzles of the duct and mixing zone where combustion occurs. And, finally, U.S. Pat. No. 5,799,594 to Dernjatin et al. teaches a method and apparatus for combustion of pulverized fuel in a tangentially fired boiler in which an air-deficient mixture of fuel and primary air is introduced through a fuel feeding pipe tangentially into the furnace of the boiler, forming a reducing flame, and at least one stream of combustion air is injected into the furnace.

Although significant strides have been made in the area of pulverized coal combustion to reduce $NO_x$ emissions generated by the combustion of pulverized coal, $NO_x$ emissions from coal fired facilities continues to be problematic. In addition, it is frequently the case that methods and apparatuses for reducing $NO_x$ emissions from heating apparatuses in which the fuel is pulverized coal undesirably impact other elements of the combustion process such as flame stability, turn down capability, $CO_2$ emissions, and combustion efficiency.

SUMMARY OF THE INVENTION

It is one object of this invention to provide a method and apparatus for pulverized coal combustion which results in a reduction in $NO_x$ emissions compared to conventional pulverized coal combustion methods and apparatuses.

It is another object of this invention to provide a method and apparatus for pulverized coal combustion which reduces the amount of $CO_2$ generated and emitted compared to conventional pulverized coal combustion methods and apparatuses.

It is yet another object of this invention to provide a method and apparatus for pulverized coal combustion that provides improved combustion performance such as improved flame stability and greater turn down capability than known methods and apparatuses.

These and other objects of this invention are addressed by a method for low-$NO_x$ combustion of a pulverized solid fuel in which a mixture of the pulverized solid fuel and a gaseous carrier fluid is introduced into a concentrating vessel in which the concentration of the pulverized solid fuel per unit of carrier gas by weight is increased. Concurrent therewith, an auxiliary fuel is burned under fuel-rich conditions producing at least one stream of hot combustion products. The concentrated pulverized solid fuel is preheated by mixing with the hot combustion products, resulting in devolatilization of at least a portion of the concentrated pulverized solid fuel and formation of devolatilized pulverized solid fuel and devolatilization products. The preheated pulverized solid fuel and the devolatilization products are burned in a burner which fires directly into a combustion chamber, forming a primary combustion zone in the combustion chamber. In accordance with a particularly preferred embodiment of this invention, the pulverized solid fuel is coal. It should be noted that the step of concentrating the pulverized solid fuel is optional, since not all pulverized solid fuels will require concentration prior to preheating.

A device for low-$NO_x$ combustion of a pulverized solid fuel utilizing the method of this invention comprises a partial oxidation combustor having an auxiliary fuel input and a partial oxidation combustion products outlet, and at least one mixing chamber wall enclosing a mixing chamber and forming at least one mixing chamber inlet opening in fluid communication with a concentrated pulverized solid fuel source and the partial oxidation combustion products outlet of the partial oxidation combustor, and having a pulverized solid fuel/combustion products mixture outlet. The device further comprises at least one preheater wall which encloses a preheating chamber and forms a preheater inlet opening which is in fluid communication with the pulverized solid fuel/combustion products mixture outlet and which forms a preheated pulverized solid fuel outlet opening. A pulverized solid fuel combustor comprising a pulverized solid fuel burner and a combustion chamber is provided wherein the pulverized solid fuel burner includes a burner inlet in fluid communication with the preheated pulverized solid fuel outlet opening through which preheated pulverized solid fuel is introduced into the burner, a burner outlet in fluid communication with the combustion chamber, and a primary combustion oxidant inlet.

As detailed hereinbelow, a large variety of embodiments of the method and apparatus of this invention are possible. However, embodiments which are not specifically described herein but which fall within the scope of the invention defined by the claims hereof are deemed to be within the scope of this invention. In addition, while the detailed description hereinbelow is directed to coal as the pulverized solid fuel, it will be appreciated that the method and apparatus of this invention may be applied to other solid fuels, such as biomass and wood waste, and, thus, applications to such other solid fuels are deemed to be within the scope of this invention.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

As previously stated, the pulverized solid fuel combustion method and apparatus of this invention are applicable to a variety of furnaces, boilers and other combustion chambers. By the term "pulverized solid fuel," we mean a solid fuel having particle sizes whereby the particles are capable of being suspended in the carrier fluid, typically air, by which the particles are conveyed to the solid fuel burner. In the case of pulverized coal, particle sizes are typically such that about 90% of the particles can pass through a 200 mesh screen, that is less than about 75 microns. In the case of biomass, for a carrier fluid velocity corresponding to the carrier fluid velocity for pulverized coal, the particle sizes are such that about 90% of the particles can pass through a 100 mesh screen, that is less than about 150 microns.

Figure 1:
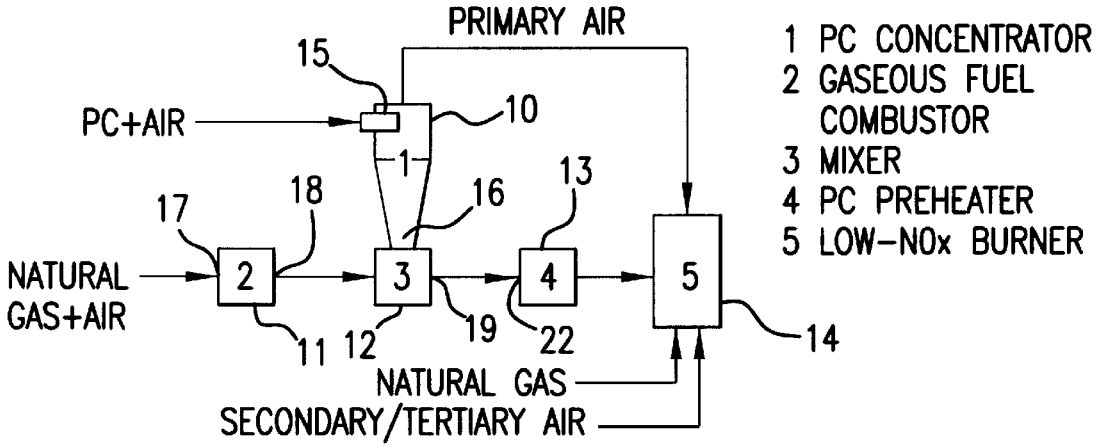
FIG. 1 is a schematic diagram showing the basic low-$NO_x$ pulverized solid fuel combustion process of this invention as well as elements of the apparatus of this invention for carrying out the process.
Figure 6:
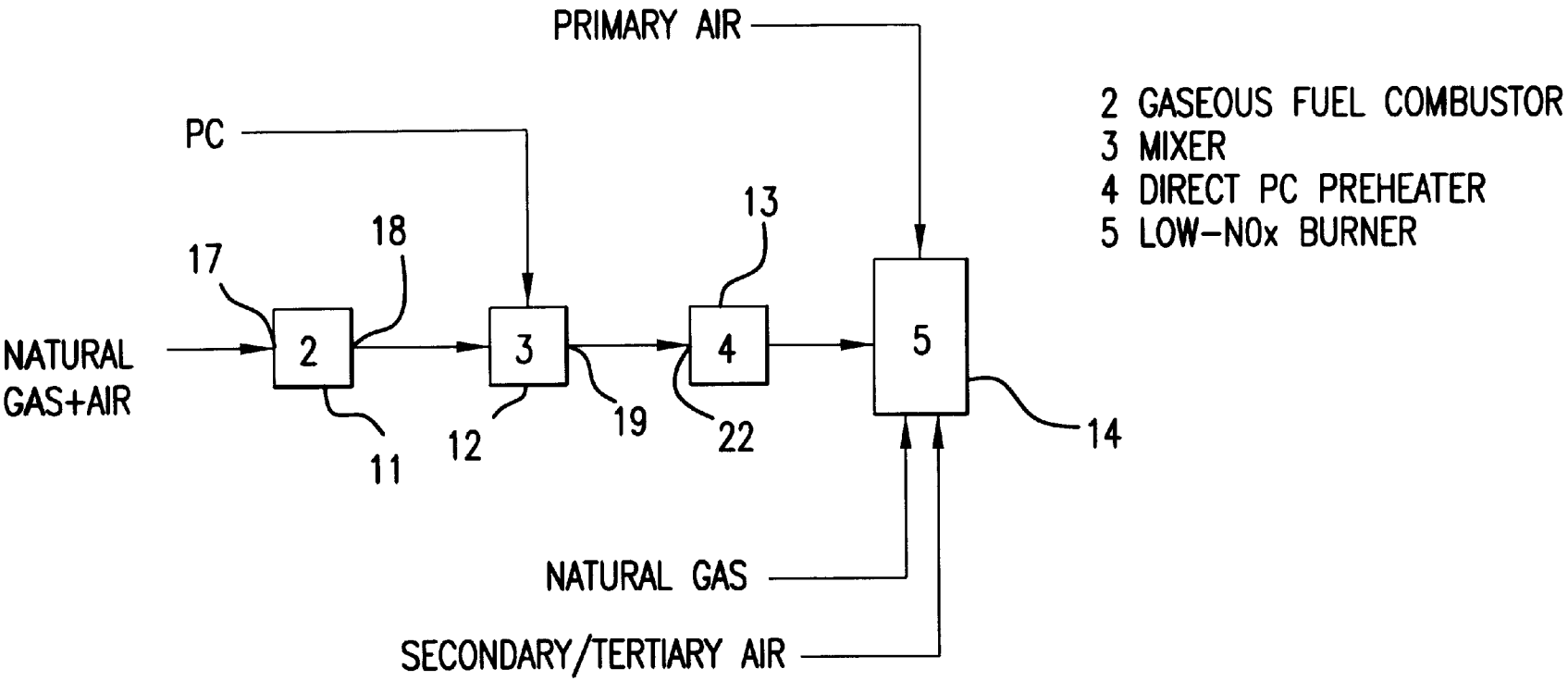
FIG. 6 is a schematic diagram showing the basic low-$NO_x$ pulverized solid fuel combustion process of this invention as well as elements of the apparatus of this invention for carrying out the process in accordance with yet another embodiment of this invention.

Referring to FIG. 1, the method for low-$NO_x$ combustion of pulverized coal in accordance with one embodiment of this invention comprises introducing a mixture of pulverized coal and a gaseous carrier fluid into a pulverized coal concentration vessel through a means for introducing said mixture 15 in which the concentration of pulverized coal is increased. In accordance with one preferred embodiment of this invention, the carrier gas stream is air. A concentrated pulverized coal stream comprising more than two parts of coal per one part of gaseous carrier fluid by weight is output from pulverized coal concentration vessel 10 through concentrated pulverized coal outlet 16. An auxiliary fuel is burned under fuel-rich conditions in partial oxidation combustor 11 having auxiliary fuel input 17 and partial oxidation combustion products outlet 18. In accordance with one preferred embodiment of this invention, the auxiliary fuel is natural gas which is combusted in air at an air-to-fuel stoichiometric ratio in the range of about 0.70 to about 0.95. At least one stream of hot combustion products resulting from burning of the auxiliary fuel is output from partial oxidation combustor 11 through partial oxidation combustion products outlet 18 and mixed with concentrated pulverized coal output through concentrated pulverized coal outlet 16 from pulverized coal concentration vessel 10 and mixer 12. The mixture of concentrated pulverized coal and hot combustion gases is output through a pulverized coal/combustion products mixture outlet 19 and introduced through preheater inlet opening 22, which is in fluid communication with pulverized coal/combustion products mixture outlet 19, into pulverized coal preheater 13 in which the concentrated pulverized coal is preheated to a temperature in the range of about 1200° to about 1600° F. by the transfer of heat from the hot combustion products from partial oxidation combustor 11. In accordance with one particularly preferred embodiment of this invention, at this point in the process, the gaseous atmosphere contains less than one percent oxygen by volume. Preheating of the concentrated pulverized coal in pulverized coal preheater 13 results in the release of combustible gases and liquids due to the devolatilization of at least a portion of the concentrated pulverized coal. The preheated pulverized coal and pulverized coal devolatilization products are then combusted in pulverized coal combustor 14 which comprises a closed-coupled low-$NO_x$ burner which fires directly into a combustion chamber. Primary air to the pulverized coal combustor 14 is preferably in the range of about 20% to about 30% by volume of the total combustion air required for complete combustion, secondary combustion air is preferably in the range of about 35% to about 45% by volume of the total combustion air, and tertiary or overfire air is preferably in the range of about 30% to about 40% by volume of the total combustion air. FIG. 6 shows the method for low-$NO_x$ combustion of pulverized coal in accordance with an alternative embodiment of this invention wherein the pulverized coal is fed directly into mixer 12.

Figure 2:
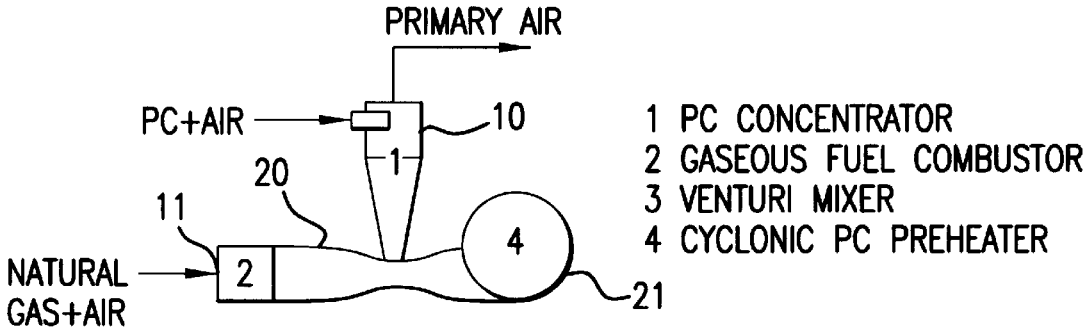
FIG. 2 is a schematic diagram of a solid fuel concentrating, mixing and preheating apparatus in accordance with one embodiment of the apparatus of this invention.
Figure 3:
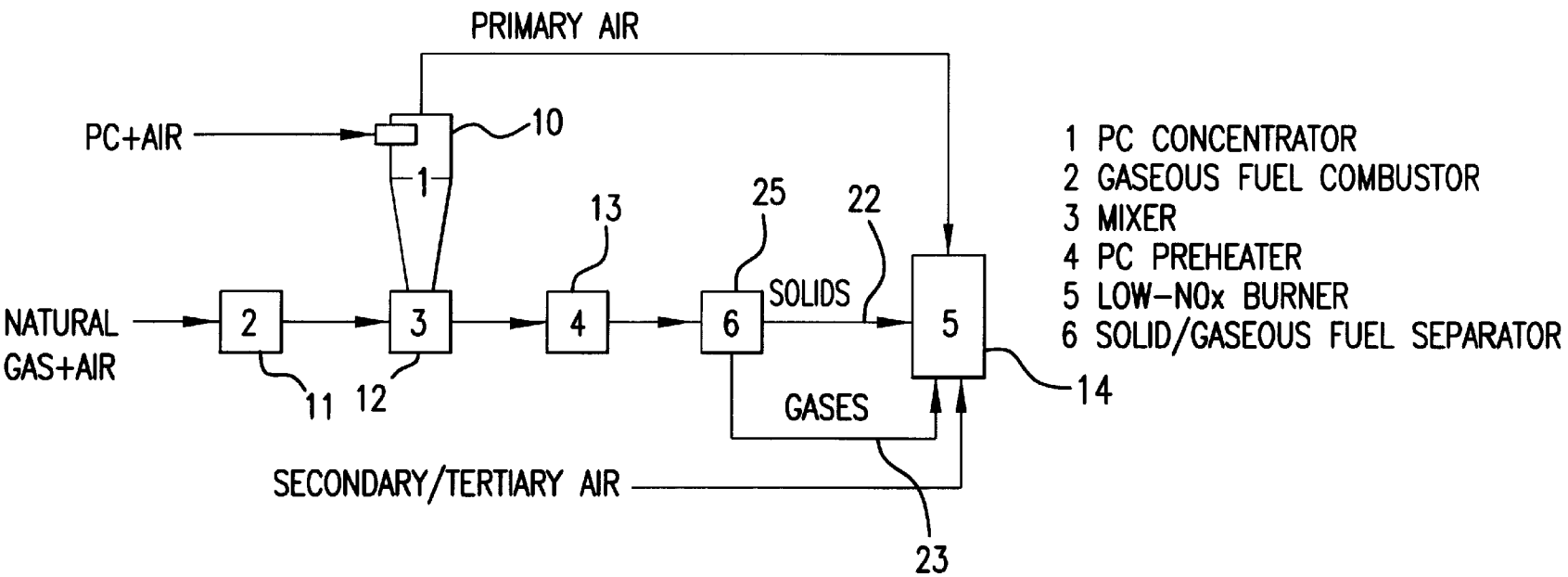
FIG. 3 is a schematic diagram of one embodiment of the method of this invention employing a solid/gaseous fuel separator for separation of the preheated pulverized solid fuel from the devolatilization products.

The design of an apparatus in accordance with one embodiment of this invention incorporating concentrator 10, partial oxidation combustor 11, mixer 12, and pulverized coal preheater 13 is shown in FIG. 2. The mixer in accordance with a particularly preferred embodiment is a venturi 20 and is employed to direct concentrated pulverized coal from pulverized coal concentration vessel 10 into the hot gaseous product stream from partial oxidation combustor 11. In accordance with the embodiments shown in FIG. 2, the apparatus preferably comprises a cyclonic pulverized coal preheater 21 which permits a pulverized coal residence time in the range of about 0.025 seconds to about 0.075 seconds with a particle heating rate of about 10,000° F. per second to about 30,000° F. per second. An alternative embodiment of the method and apparatus of this invention are shown in FIG. 3 wherein the preheated pulverized coal is separated from the gaseous devolatilization products by means of a solid/gaseous fuel separator 25. The separated preheated pulverized coal and gaseous devolatilization products are introduced separately as indicated by lines 22 and 23 into pulverized coal combustor 14.

Figure 4:
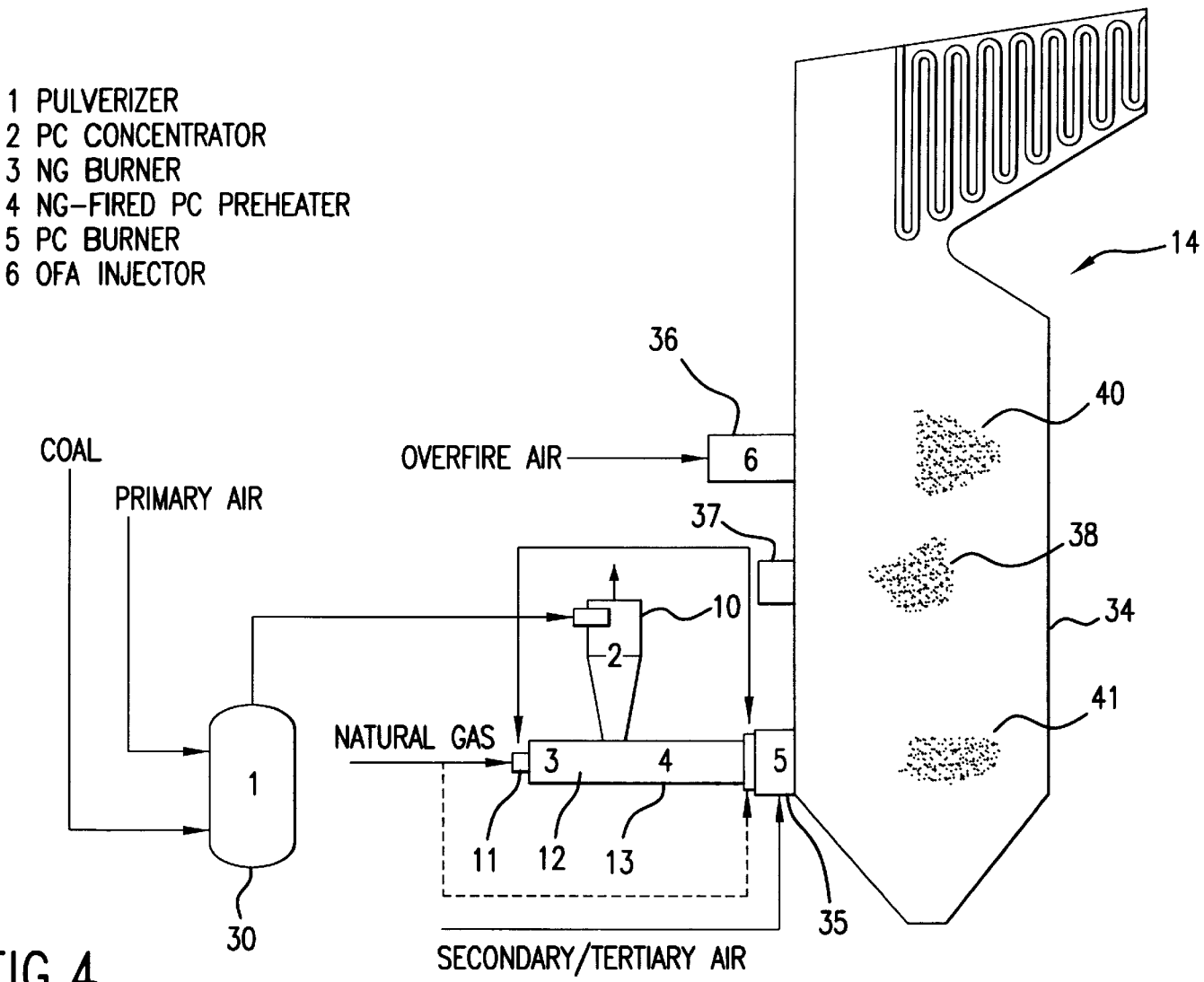
FIG. 4 is a schematic diagram of a low-$NO_x$ pulverized solid fuel combustion process utilizing overfire air in accordance with one embodiment of this invention.

Yet another embodiment of the process and apparatus of this invention is shown in FIG. 4. In accordance with this embodiment, coal is pulverized in pulverizer 30 and mixed with primary air as the carrier fluid and introduced into pulverized coal concentration vessel 10. The concentrated pulverized coal is introduced into an integrated mixer/preheater comprising partial oxidation combustor 11, mixer 12 and pulverized coal preheater 13. The output from the integrated apparatus is conveyed to pulverized coal burner 35 in which the preheated concentrated pulverized coal is burned. The combustion of the preheated concentrated pulverized coal results in the formation of primary combustion zone 41 in combustion chamber 34. In accordance with the embodiments shown in FIG. 4, overfire air is introduced into combustion chamber 34 through overfire injector 36 resulting in the formation of a burnout zone 40 disposed downstream of primary combustion zone 41, in which burnout zone any CO remaining in the combustion products is oxidized to $CO_2$.

Figure 5:
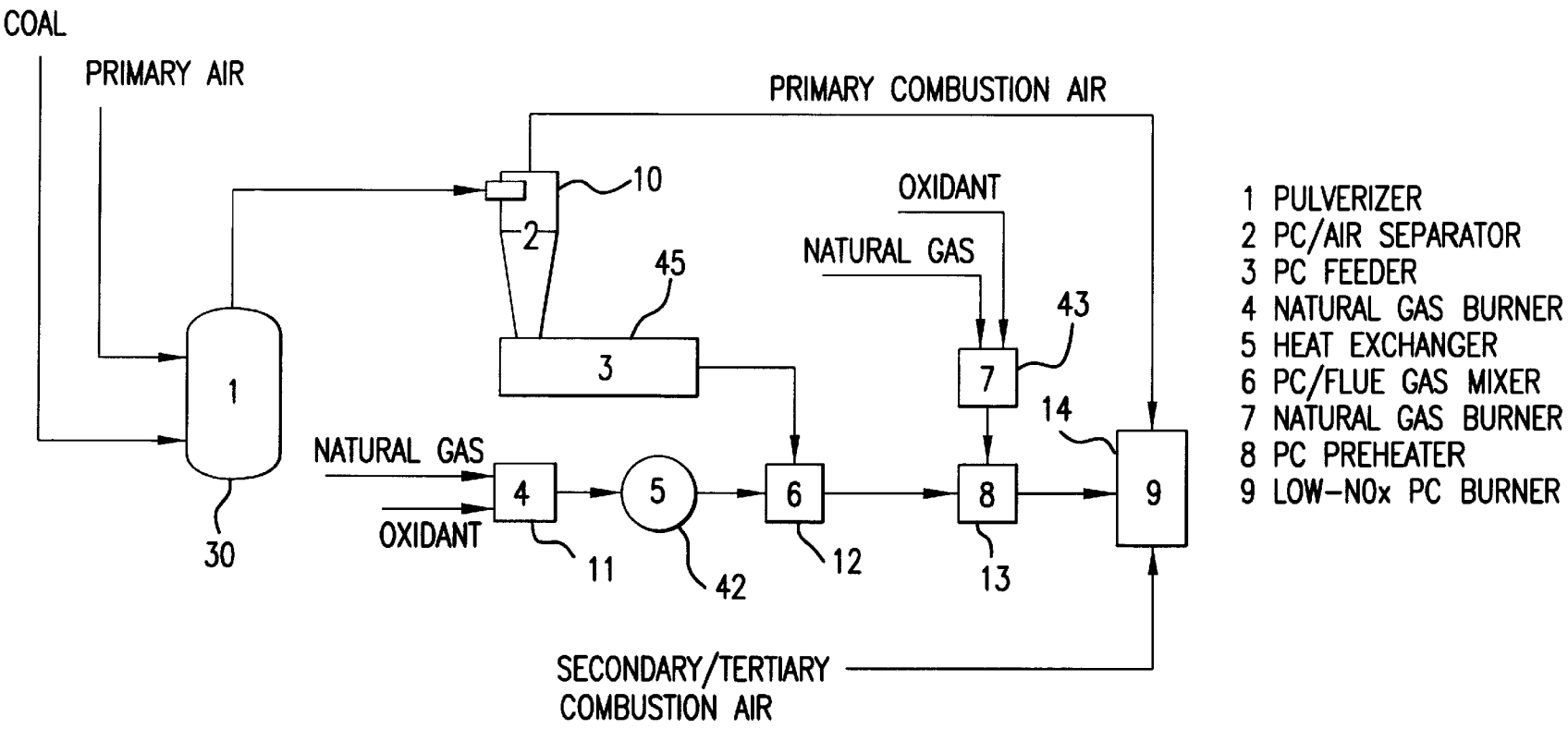
FIG. 5 is a schematic diagram of a low-$NO_x$ pulverized solid fuel combustion system in accordance with one embodiment of this invention.

Shown in FIG. 5 is a further embodiment of the process and apparatus of this invention wherein pulverized coal concentration vessel 10 removes sufficient air from the pulverized coal/air stream to increase the pulverized coal-to-air weight ratio to greater than 99 to 1. In this case, the pulverized coal is transported using a conventional pulverized coal feeder 45 to the mixer 12. The auxiliary fuel is combusted in partial oxidation combustor 11 to produce combustion products which are cooled by means of a heat exchanger 42 and then mixed with pulverized coal in mixer 12. Pulverized coal is entrained by the cooled combustion products and transported to pulverized coal preheater 13 which is heated by hot flue gases from a secondary fuel burner 43.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for low-$NO_x$ combustion of a pulverized solid fuel comprising the steps of:

burning an auxiliary fuel under fuel-rich conditions, producing at least one stream of combustion products;

mixing a mixture of pulverized solid fuel and a gaseous carrier fluid with said combustion products, forming a mixture of said pulverized solid fuel, said gaseous carrier fluid, and said combustion products;

heating said pulverized solid fuel and said gaseous carrier fluid by mixing with combustion products in a preheater, resulting in preheated pulverized solid fuel and devolatilization of at least a portion of said pulverized solid fuel and formation of devolatilization products; and burning said preheated pulverized solid fuel and said devolatilization products in a combustor comprising a burner firing directly into a combustion chamber, resulting in formation of a primary combustion zone within said combustor.

2. A method in accordance with claim 1, wherein prior to mixing of said pulverized solid fuel with said combustion products said mixture of pulverized solid fuel and said gaseous carrier fluid is conveyed into a concentrating vessel, producing concentrated pulverized solid fuel.

3. A method in accordance with claim 1, wherein said auxiliary fuel is burned in air at an air/fuel stoichiometric ratio of about 0.70 to about 0.95.

4. A method in accordance with claim 1, wherein said auxiliary fuel is natural gas.

5. A method in accordance with claim 1, wherein said pulverized solid fuel is preheated to a temperature in a range of about 1200° to about 1600° F.

6. A method in accordance with claim 1, wherein said gaseous carrier fluid is air.

7. A method in accordance with claim 6, wherein at least a portion of said air is introduced into said combustor as primary combustion air.

8. A method in accordance with claim 7, wherein said primary combustion air comprises in a range of about 20% to about 30% by volume of a total amount of combustion air utilized for combustion of said preheated pulverized solid fuel and devolatilization products.

9. A method in accordance with claim 7, wherein a remaining portion of said combustion air is introduced into said combustor in stages.

10. A method in accordance with claim 9, wherein said remaining portion of said combustion air comprises secondary combustion air in a range of about 35% to about 45% by volume of said total amount of combustion air and tertiary combustion air in a range of about 30% to about 40% by volume of said total amount of combustion air.

11. A method in accordance with claim 9, wherein said primary combustion air is introduced into said burner.

12. A method in accordance with claim 8, wherein said remaining portion of said combustion air is introduced into said burner.

13. A method in accordance with claim 1, wherein said devolatilization products comprise a gaseous phase which is separated from said preheated pulverized solid fuel prior to introduction into said combustor.

14. A method in accordance with claim 10, wherein said tertiary combustion air is introduced into said combustor downstream of said secondary combustion air.

15. A method in accordance with claim 7, wherein at least a portion of a remaining portion of said air is introduced into said combustor as secondary combustion air, resulting in formation of a secondary combustion zone downstream of said primary combustion zone.

16. A method in accordance with claim 15, wherein a remaining portion of said remaining portion of said air is introduced into said combustor as tertiary combustion air, resulting in formation of a tertiary combustion zone downstream of said secondary combustion zone.

17. A method in accordance with claim 15, wherein overfire air is introduced into said combustion chamber downstream of said secondary combustion zone.

18. A method in accordance with claim 15, wherein a gaseous fuel is introduced into at least one of said primary combustion zone and said secondary combustion zone, resulting in oxygen-deficient combustion of said preheated pulverized solid fuel.

19. A method in accordance with claim 1, wherein at least one of said pulverized solid fuel and said stream of combustion products are introduced tangentially into a cyclonic preheater for said preheating of said pulverized solid fuel.

20. A method in accordance with claim 1, wherein said pulverized solid fuel is selected from the group consisting of pulverized coal, pulverized biomass, and mixtures and combinations thereof.

21. An apparatus for low-$NO_x$ combustion of a pulverized solid fuel comprising:

a pulverized solid fuel supply;

a partial oxidation combustor having an auxiliary fuel input and a partial oxidation combustion products outlet;

at least one mixing chamber wall enclosing a mixing chamber and forming at least one mixing chamber inlet opening in fluid communication with said pulverized solid fuel supply and said partial oxidation combustion products outlet and having a pulverized solid fuel/combustion products mixture outlet;

at least one preheater wall enclosing a preheating chamber and forming a preheater inlet opening in fluid communication with said pulverized solid fuel/combustion products mixture outlet and forming a preheated pulverized solid fuel outlet opening; and a pulverized solid fuel combustor comprising a pulverized solid fuel burner and a combustion chamber, said pulverized solid fuel burner having a burner inlet in fluid communication with said preheated pulverized solid fuel outlet opening, a burner outlet in fluid communication with said combustion chamber, and a primary combustion oxidant inlet.

22. An apparatus in accordance with claim 20 further comprising a solid/gaseous fuel separator disposed between said preheating chamber and said pulverized solid fuel combustor and said separator having a separator inlet in fluid communication with said preheated pulverized solid fuel outlet opening and a gaseous fuel separator outlet and said separator having a solids outlet in fluid communication with said pulverized solid fuel combustor.

23. An apparatus in accordance with claim 21, wherein said mixing chamber is a venturi.

24. An apparatus in accordance with claim 21, wherein said preheating chamber is a cyclonic preheating chamber.

25. An apparatus in accordance with claim 21, wherein said pulverized solid fuel combustor comprises means for introducing secondary combustion oxidant into said pulverized solid fuel combustor.

26. An apparatus in accordance with claim 25, wherein said pulverized solid fuel combustor comprises means for introducing a tertiary combustion oxidant into said pulverized solid fuel combustor.

27. An apparatus in accordance with claim 21, wherein said at least one mixing chamber wall forms a primary oxidant outlet opening in fluid communication with said primary combustion oxidant inlet of said pulverized solid fuel combustor.

28. An apparatus in accordance with claim 21, wherein said combustion chamber comprises overfire air means for introducing overfire air into said combustion chamber.

29. An apparatus in accordance with claim 21 further comprising a gaseous fuel combustor having a gaseous fuel combustion products outlet in fluid communication with said preheating chamber.

30. An apparatus in accordance with claim 21 further comprising a pulverized solid fuel concentration vessel having means for introducing a mixture of said pulverized solid fuel and a gaseous carrier fluid into said pulverized solid fuel vessel and a concentrated pulverized solid fuel outlet.

31. An apparatus in accordance with claim 30 further comprising a pulverized solid fuel feeder adapted to convey concentrated pulverized solid fuel from said concentrated pulverized solid fuel outlet of said pulverized solid fuel concentration vessel into said mixing chamber.

* * * * *

UNITED STATES PATENT AND TRADEMARK OFFICE

CERTIFICATE OF CORRECTION

PATENT NO. : 6,244,200 B1
DATED : June 12, 2001
INVENTOR(S) : Iosif Rabovitser et al.

It is certified that error appears in the above-identified patent and that said Letters Patent is hereby corrected as shown below:

Column 5,
Line 62, before "overfire" insert -- secondary combustion air is introduced through injector 37 into combustion chamber 34 to form secondary combustion zone 38 and tertiary or --.
Line 64, after "burnout" insert -- tertiary combustion --.

Signed and Sealed this

Twenty-fifth Day of December, 2001

*Attest:*

*Attesting Officer*

JAMES E. ROGAN
*Director of the United States Patent and Trademark Office*